US005323585A

United States Patent [19]

Kazlauskas

[11] Patent Number: 5,323,585

[45] **Date of Patent: * Jun. 28, 1994**

[54] MACHINE AND METHOD FOR CLIPPING GENERALLY PLANAR SHEETS ONTO RECTANGULARLY ARRAYED CANS HAVING CHIMES

[75] Inventor: Algimantas K. Kazlauskas, Orland Park, Ill.

[73] Assignee: Illinois Tool Works Inc., Glenview, Ill.

[ * ] Notice: The portion of the term of this patent subsequent to Feb. 9, 2010 has been disclaimed.

[21] Appl. No.: 960,011

[22] Filed: Oct. 13, 1992

Related U.S. Application Data

[63] Continuation of Ser. No. 832,007, Feb. 6, 1992, Pat. No. 5,184,448.

[51] Int. Cl.[5] ..... B65B 5/06; B65B 21/06; B65B 21/24

[52] U.S. Cl. ..... 53/48.1

[58] Field of Search ..... 53/398, 48.1, 48.7, 53/48.9, 580

[56] References Cited

U.S. PATENT DOCUMENTS

| | | | |
|---|---|---|---|
| 2,917,877 | 12/1959 | Fisher | 53/48.1 X |
| 2,933,867 | 4/1960 | Gentry | 53/398 |
| 3,094,210 | 6/1963 | Van Den Berg | 53/48.1 X |
| 3,182,431 | 5/1965 | Ganz | 53/398 |
| 4,501,104 | 2/1985 | Griffin et al. | 53/398 X |
| 4,612,753 | 9/1986 | Taylor et al. | 53/398 |
| 4,643,633 | 2/1987 | Lashyro | 414/732 |
| 4,974,726 | 12/1990 | Klygis et al. | 206/158 |
| 5,099,632 | 3/1992 | Klygis et al. | 53/398 |
| 5,184,448 | 2/1993 | Kazlauskas | 53/398 |

*Primary Examiner*—Horace M. Culver
*Attorney, Agent, or Firm*—Dressler, Goldsmith, Shore & Milnamow, Ltd.

[57] ABSTRACT

A machine and related method for clipping a succession of generally planar sheets according to U.S. Pat. No. 4,974,726 onto a succession of rectangular arrays of cans of a type having an end with a chime. Each sheet has two lines of can-stabilizing strips defined by generally parallel slits and two longitudinal edge portions defined thereby. Successive arrays of cans are registered in such manner that successive cans are spaced regularly and are conveyed with one such sheet overlying the cans of each array. After transversely spaced wheels engage successive edge portions of successive sheets to clip such edge portions beneath the chimes of adjacent cane being conveyed, successive lobes of transversely spaced, lobar wheels engage of successive strips of successive sheets as successive arrays are conveyed. The arrays of cane are registered relative to the lobes of the lobar wheels.

3 Claims, 3 Drawing Sheets

MACHINE AND METHOD FOR CLIPPING GENERALLY PLANAR SHEETS ONTO RECTANGULARLY ARRAYED CANS HAVING CHIMES

This application is a continuation of application Ser. No. 07/832,007, filed Feb. 6, 1992, and now U.S. Pat. No. 5,184,448.

TECHNICAL FIELD OF THE INVENTION

This invention pertains to a novel machine and a related method for clipping a succession of generally planar sheets onto a succession of rectangular arrays of cans of a type having an end with a chime. The sheets stabilize the arrayed cans and cover substantial portions of the ends with the chimes.

BACKGROUND OF THE INVENTION

A generally planar sheet of paperboard or polymeric material for stabilizing a rectangular array of cans of a type having an end with a chime and for covering substantial portions of those ends of the arrayed cans is disclosed in Klygis et al. U.S. Pat. No. 4,974,726, hereinafter "Klygis et al. patent", the disclosure of which is incorporated herein by reference.

As disclosed in the Klygis et al. patent, the sheet has multiple pairs of substantially parallel slits, which define can-stabilizing strips and longitudinal edge portions. The sheet is described therein as clippable onto the cans in the rectangular array in such manner that portions of the chimes of the respective cans extend into the slits of the respective pairs and that each strip fits, without folding such strip, under portions of the chimes of two adjacent cans.

It is disclosed in the Klygis et al. patent that the sheet may be clipped onto the cans in a manual operation or in an automated operation, such as a rolling operation, in which the strips are forced downwardly relative to a planar portion of the sheet, for example by a cogged or selectively actuatable roller, so as to snap beneath the chimes of the adjacent cans. It also is disclosed therein that the longitudinal edge portions may be simultaneously or subsequently folded downwardly along folding lines defined by certain of the slits.

A need has arisen, to which this invention is addressed, for a machine for clipping a succession of generally planar sheets onto a succession of rectangular arrays of cans of the type noted above, possibly at high speeds characteristic of modern filling and packaging operations.

SUMMARY OF THE INVENTION

This invention provides such a machine and a related method for clipping a succession of generally planar sheets onto a succession of rectangular arrays of cans of a type having an end with a chime. Each sheet is similar to the sheet disclosed in the Klygis et al. patent. The pairs of slits defining can-stabilizing strips of successive sheets are similarly spaced in a longitudinal direction along each sheet and from each sheet to the successive sheet.

The machine comprises a mechanism for registering successive arrays of cans in such manner that successive cans are spaced regularly in a longitudinal direction and for conveying the registered arrays in the longitudinal direction with the ends with the chimes facing upwardly. One such sheet overlies the chimes of the cans of each array in such manner that the chime of each can is disposed in a centered position relative to the slits of one respective pair.

The machine comprises a mechanism for clipping the overlying sheet onto each array as such array is conveyed. The clipping mechanism comprises at least one lobar wheel provided with peripherally arrayed lobes. The lobar wheel is rotatable in such manner that successive lobes engage successive can-stabilizing strips of successive sheets so as to clip these successive strips beneath the chimes of successive cans as successive arrays are conveyed.

A mechanism is provided for rotating the lobar wheel in a manner coordinated with operation of the registering and conveying means to ensure that successive lobes engage successive strips of successive sheets to clip successive strips beneath the chimes of successive cans as successive arrays are conveyed.

Preferably, the lobes have curved edges and are tapered on each side to engage middle portions of the strips, as measured longitudinally and transversely.

So as to accommodate such sheets having a number of parallel lines of can-stabilizing strips, the clipping mechanism may comprise a like number of such lobar wheels. The lobar wheels are spaced transversely to engage the generally parallel lines of successive strips.

In a preferred embodiment, the clipping mechanism comprises a pair of circular, transversely spaced wheels. The circular wheels are arranged to engage successive edge portions of successive sheets and to fold the engaged portions in such manner that the folded portions are clipped beneath the chimes of outer cans in the rectangular arrays being conveyed.

Preferably, the circular wheels are arranged to engage the edge portions of each sheet before the lobar wheel engages any of the strips of such sheet. It is useful for each of the circular wheels to be transversely movable over a limited range of motion and to be also biased toward an inner limit of the range.

These and other objects, features, and advantages of this invention are evident from the following description of a preferred embodiment of this invention with reference to the accompanying drawings.

DETAILED DESCRIPTION OF PREFERRED EMBODIMENT

Figures 1, 7, 8:
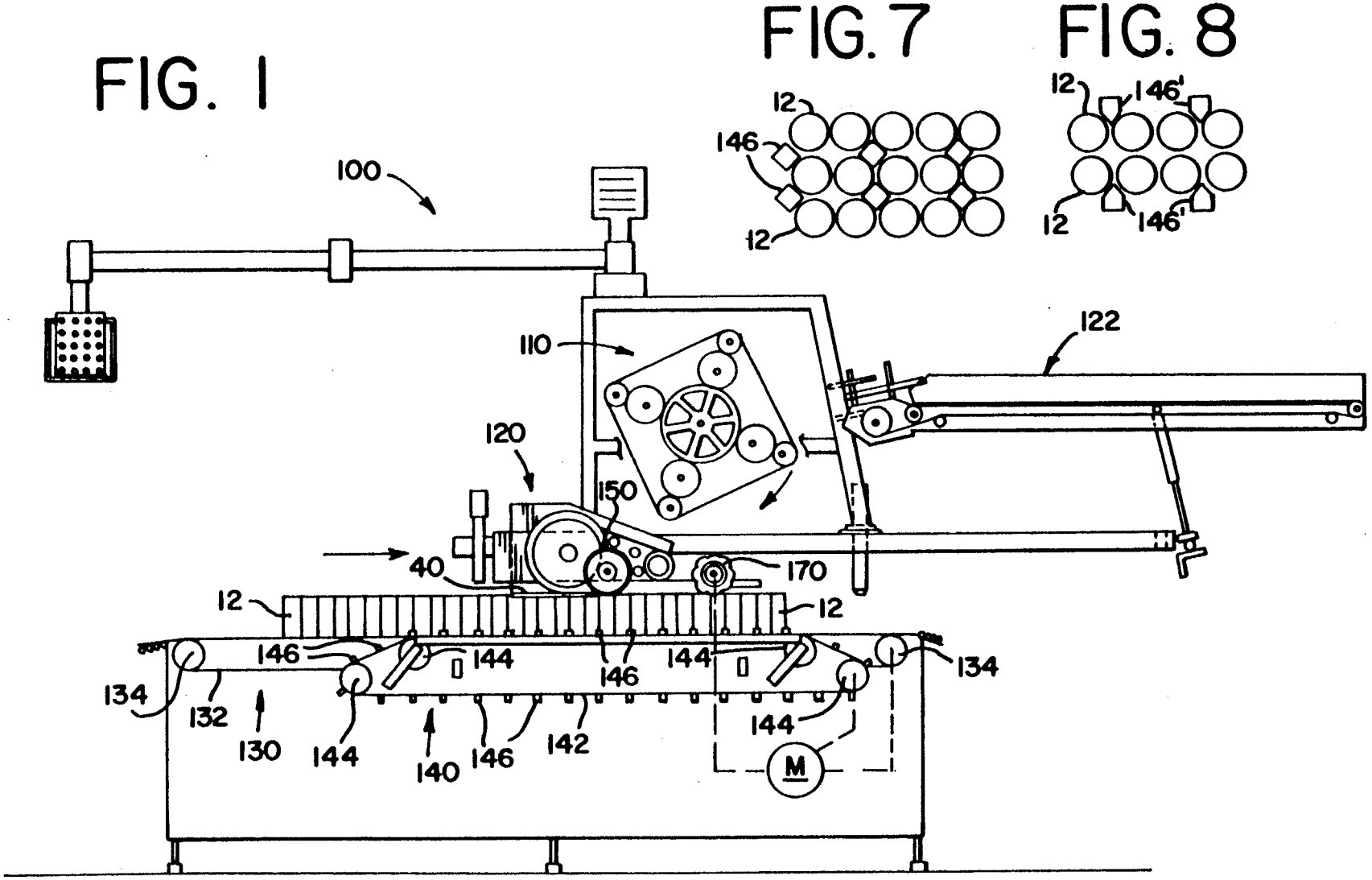
FIG. 1 is a simplified, schematic, view of a novel machine according to this invention for clipping a succession of generally planar sheets onto a succession of rectangular arrays of cans of a type having an end with a chime.
FIG. 7 is a fragmentary, diagrammatic, plan view showing a preferred embodiment of a conveyor of the machine shown in FIG. 1.
FIG. 8 is a fragmentary, diagrammatic, plan view showing an alternate embodiment of a conveyor of the machine shown in FIG. 1.

As shown in FIG. 1, a machine 100 for clipping a succession of generally planar sheets 40 onto a succession of rectangular arrays of cans 12 of the type noted above constitutes a preferred embodiment of this invention. The machine 100 produces a succession of similar merchandising packages like the merchandising package shown in FIG. 6.

Each can 12 has a cylindrical side wall 14. Each can 12 has an openable end, which is its upper end in the drawings, with a flange-like chime 16. A pull-tab (not shown) may be operatively mounted to the openable end.

Figure 5:
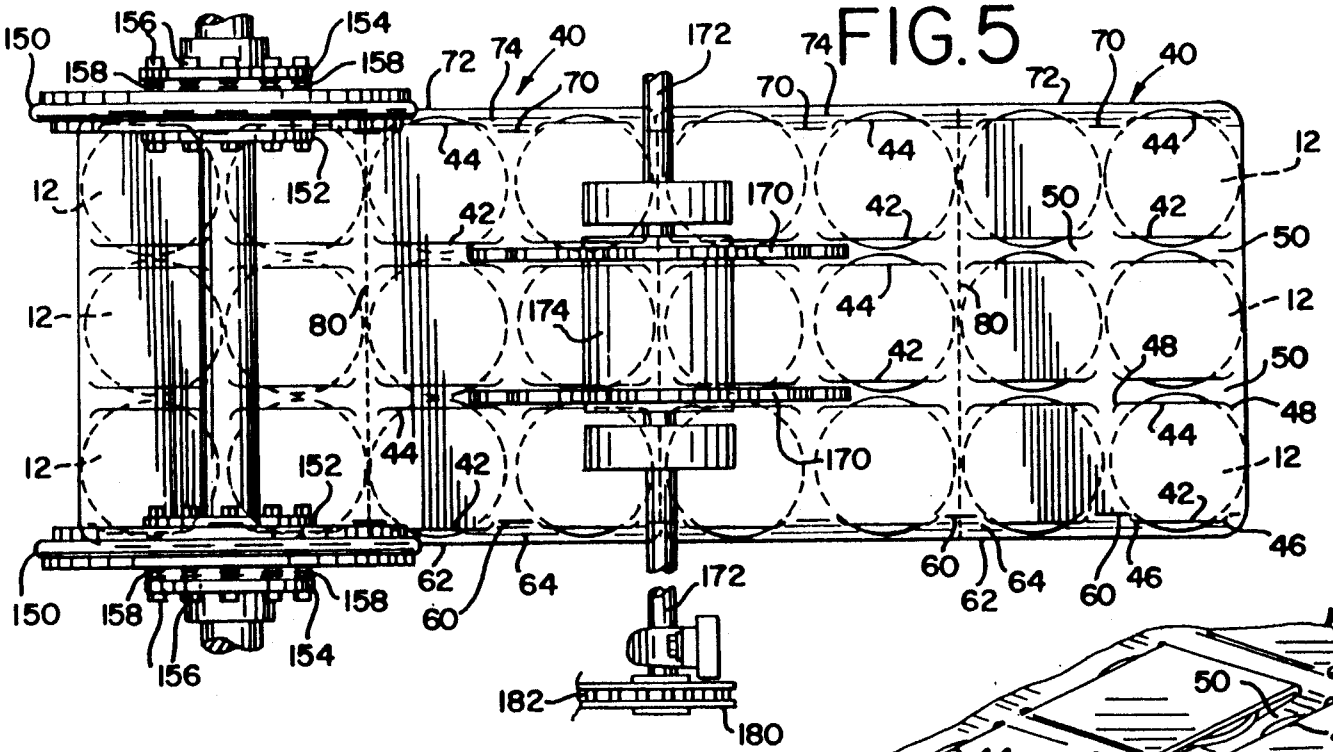
FIG. 5 is a fragmentary, plan view of the lobar and circular wheels and two successive sheets overlying two successive arrays of cans.

Each rectangular array may have four, six, twelve, twenty-four, or a different number of cans 12. As shown in FIG. 5, each rectangular array of cans 12 comprises twelve cans, in three longitudinal rows and four transverse ranks. The openable ends with the chimes 16 face upwardly. Although it is preferred that each rectangular array has three longitudinal rows, this invention may be also used if each rectangular array has a different number of longitudinal rows, possibly two longitudinal rows.

Figure 6:
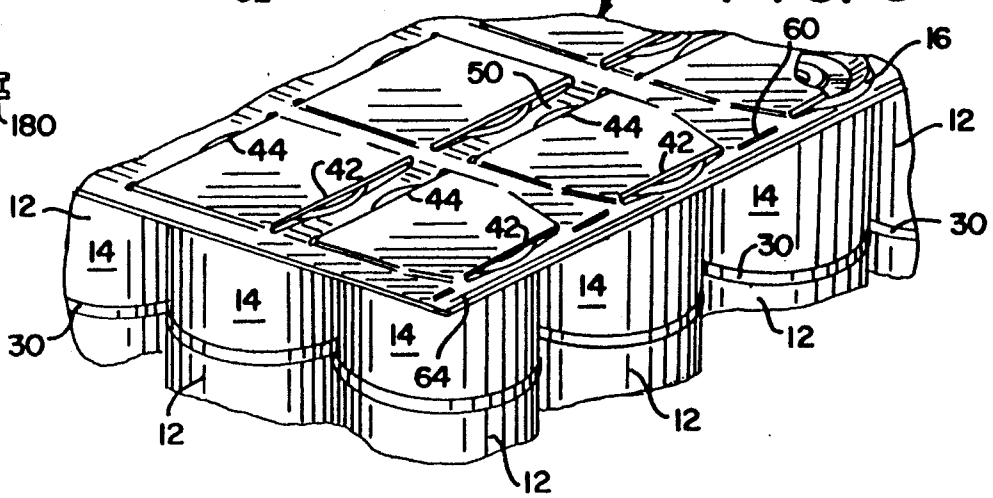
FIG. 6 is a fragmentary, perspective view of a merchandising package comprising such an array of cans, a carrier applied thereto, and a planar sheet applied thereto, as contemplated by this invention.

As shown in FIG. 6, each rectangular array comprises a carrier 30, which is applied along the side walls 14 of the cans 12 before one of the sheets 40 is applied to such rectangular array. The carrier 30 stabilizes such rectangular array in the machine 100 and in the merchandising package produced by the machine 100. The carrier 30 is made from a thin sheet of resilient, flexible polymeric material, such as low density polyethylene, and may be any of the carriers referenced in the Klygis et al. patent.

Paperboard, more particularly point board, is a preferred material for the generally planar sheets 40 applied to the rectangular arrays of cans 12 by means of the machine 100. A filled or unfilled polymeric material, such as low density polyethylene, is an alternative material for such sheets 40. Each sheet 40, which may be die-cut, is rectangular, except for rounded corners. Each sheet 40 is similar to the sheet illustrated and described in the Klygis et al. patent and may be designed to be applied to a variety of arrays of cans arranged in ranks and rows. The machine 100 and the sheet 40 may accommodate two or more lanes of cans.

Thus, each sheet 40 has a plurality of pairs of substantially parallel slits 42, 44. The pairs of slits 42, 44, are arrayed, substantially as the cans 12 are arrayed, e.g. in a preferred embodiment in three longitudinal rows and two or four transverse ranks. Each of the slits 42, 44, is substantially straight except for its opposite ends, which are curved. In each pair of slits 42, 44, the curved ends 46 of the slit 42 and the curved ends 48 of the .slit 44 point toward each other, as shown in FIG. 5.

Also, each sheet 40 has a plurality of can-stabilizing strips 50, in longitudinal lines, with the number of such strips 50 in each line consistent with the number of ranks in the array to be packaged. The strips 50 are disposed respectively between the pairs of slits 42, 44, in each rank and are defined respectively by slits in two adjacent rows. Each strip is defined, more particularly, by one of the slits 42 and by one of the slits 44.

Moreover, each sheet 40 has two folding lines near its longitudinal edges. The folding lines are defined respectively by longitudinal rows of slits.

One folding line of each sheet 40 is defined by a longitudinal row of slits 60 aligned approximately with the ends 46 of the slits 42 nearest to one longitudinal edge 62 of such sheet 40. The folding line defined by the slits 60 and the edge 62 defines one longitudinal edge portion 64 of such sheet 40.

The other folding line of each sheet 40 is defined by a longitudinal row of slits 70 aligned approximately with the ends 48 of the slits 44 nearest to the other longitudinal edge 72 of such sheet 40. The folding line defined by the slits 70 and the edge 72 define another longitudinal edge portion 74 of such sheet 40.

Furthermore, each sheet 40 may have a breakaway line, which is defined by a transverse row of perforations 80. The breakaway line enables such sheet 40 to be readily broken into smaller sheets covering smaller arrays.

Each sheet 40 is configured to enable it to be readily clipped onto the cans 12 in one of the rectangular arrays by means of the machine 100. Specifically, each sheet 40 is clippable onto the cans 12 in such manner that portions of the chimes 16 of the respective cane 12 extend into the slits 42, 44, of the respective pairs, that each strip 50 fits, without folding such strip 50, under portions of the chimes 16 of two adjacent cans 12 in the same rank, and that planar portions 52 of such sheet 40 between the slits 42, 44, of the respective pairs cover substantial portions of the openable ends of the respective cane 12. Additionally, the longitudinal edge portions 64, 74, of such sheet 40 may be downwardly folded along the folding lines. Advantages of clipping such sheet onto the cans in this manner are explained in the Klygis et al. patent.

The sheets 40 are placed onto the rectangular arrays of cane 12, which are disposed with the openable ends with the chimes 16 facing upwardly, in any suitable manner providing that one of the sheets 40 overlies the chimes 16 of the cans 12 of each array in such manner that the chime 16 of each can 12 is disposed in a centered position relative to the slits 42, 44, of one respective pair. The sheets 40 may be manually placed. Although mechanisms for placing the sheets 40 are outside the scope of this invention, suitable mechanisms therefor are shown in FIG. 1 and are discussed below.

While the preferred embodiment of the invention contemplates discrete sheets 40 being applied to the tope of cane, it is contemplated that a continuous, interconnected supply of sheets could also be applied in accordance with the invention.

As shown in FIG. 1, a rotary transfer device 110 and a sheet transfer conveyor 120 are used to place the sheets 40 onto the rectangular arrays of cane 12, both being similar to known apparatus. The rotary transfer device 110 is similar to the rotary transfer device disclosed in Lashyro U.S. Pat. No. 4,643,633 except that the rotary transfer device has four transfer mechanisms, rather than a lesser number described in the Lashryo patent. The disclosure of Lashyro U.S. Pat. No. 4,643,633 is incorporated herein by reference. Each transfer mechanism of the rotary transfer device 110 employs a vacuum cup to hold one of the sheets 40 while it is being fed from a supply magazine 122 onto the sheet transfer conveyor 120. The sheet transfer conveyor 120 transfers each sheet 40 onto the cans 12 of one of the rectangular arrays.

As shown in FIG. 1, the machine 100 comprises a primary conveyor 130 and a secondary conveyor 140. The primary conveyor 130 comprises endless belts 132 operating on suitably spaced rollers 134 and supporting successive arrays of cans 12. The secondary conveyor 140 comprises one or more endless chains or belts 142 vertically disposed relative to the plane of movement of cans and between belts 132 of the primary conveyor 130 and operating on suitably spaced sprockets or rollers 144. The secondary conveyor 140 comprises spaced timing or registering flights or cogs 146 extending from the belt or belts 142 of the secondary conveyor 140, engaging certain of the cans 12 from below and interdigited in the spaces between adjacent cans of the arrays supported on the belts 132 of the primary conveyor 130, and defining "pockets" to register the arrays of cans 12 in such manner that successive cans 12 are spaced regularly in a longitudinal direction from each array to the next array. The primary and secondary conveyors are arranged to be conjointly driven by a motor M in a known manner.

The preferred embodiment of these cogs 146 in cooperation with the cans 12 is shown more clearly in FIG. 7, in which the cogs 146 are shown as engaging the cane 12 in the spaces between the cans 12. An alternate manner of registering the cans 12 with a horizontally disposed secondary conveyor is shown in FIG. 8. In the alternate embodiment of FIG. 8, the arrays are registered by contact of cogs 146' with sides of the outer rows of cane 12.

Operation of the rotary transfer device 110 and operation of the sheet transfer conveyor 120 are coordinated with operation of the primary and secondary conveyors to ensure that each sheet 40 is placed properly onto the cans 12 of an underlying array.

The sheet 40 overlying the cane 12 of each array supported on the belts 132 of the primary conveyor 130 and registered by the flights 146 of the secondary conveyor 140 is placed onto the cans 12 of such array in such manner that the chime 16 of each can 12 is disposed in a centered position relative to the slits 42, 44, of one respective pair. Next, as described below, the overlying sheet 40 is clipped onto the cans 12 of such array.

Two pairs of transversely spaced wheels are mounted above the rectangular arrays of cans 12 on the primary and secondary conveyors, namely a pair of circular wheels 150 and a pair of lobar wheels 170. These wheels are disposed so that the circular wheels 150 engage each sheet 40 placed onto one of the rectangular arrays of cans 12, as described above, before the lobar wheels 170 engage such sheet 40.

Each circular wheel 150 is disposed between an inner disc 152 and an outer disc 154, on peripherally spaced pins 156 extending between the discs 152, 154, as to be transversely movable on the pins 156. Each circular wheel 150 has a limited range of transverse motion defined by the discs 152, 154. A coiled spring 158 is disposed around each pin 156, between the outer disc 154 and the circular wheel 150, so as to bias the circular wheel 150 toward an inner limit of the range. The discs 152, 154, with the circular wheel 150 disposed therebetween are journalled in the machine 100, via a shaft 160 defining an axis, so as to be freely rotatable about the axis.

The circular wheels 150 are arranged to engage the longitudinal edge portions 64, 74, of each sheet 40 and to fold the engaged portions 64, 74, downwardly, along the folding lines defined by the slits 60, 70, in such manner that the folded portions 64, 74, are clipped beneath the chimes 16 of the outer cans 12 in the rectangular arrays being conveyed, by the outer regions of the chimes 16 in the outer rows becoming associated with the outermost slots 42, 44. Because each of the circular wheels 150 can move outwardly over a limited range of transverse motion, two advantageous functions are served. Firstly, the machine 100 is operational despite minor dimensional variations in the cans 12, in the sheets 40, or both. Secondly, the circular wheels 150 tend to cause the folded edges 64, 74, to assume the contours of the cans 12 as the folded edges 64, 74, are clipped beneath the chimes 16 of the outer cans 12.

Figure 2:
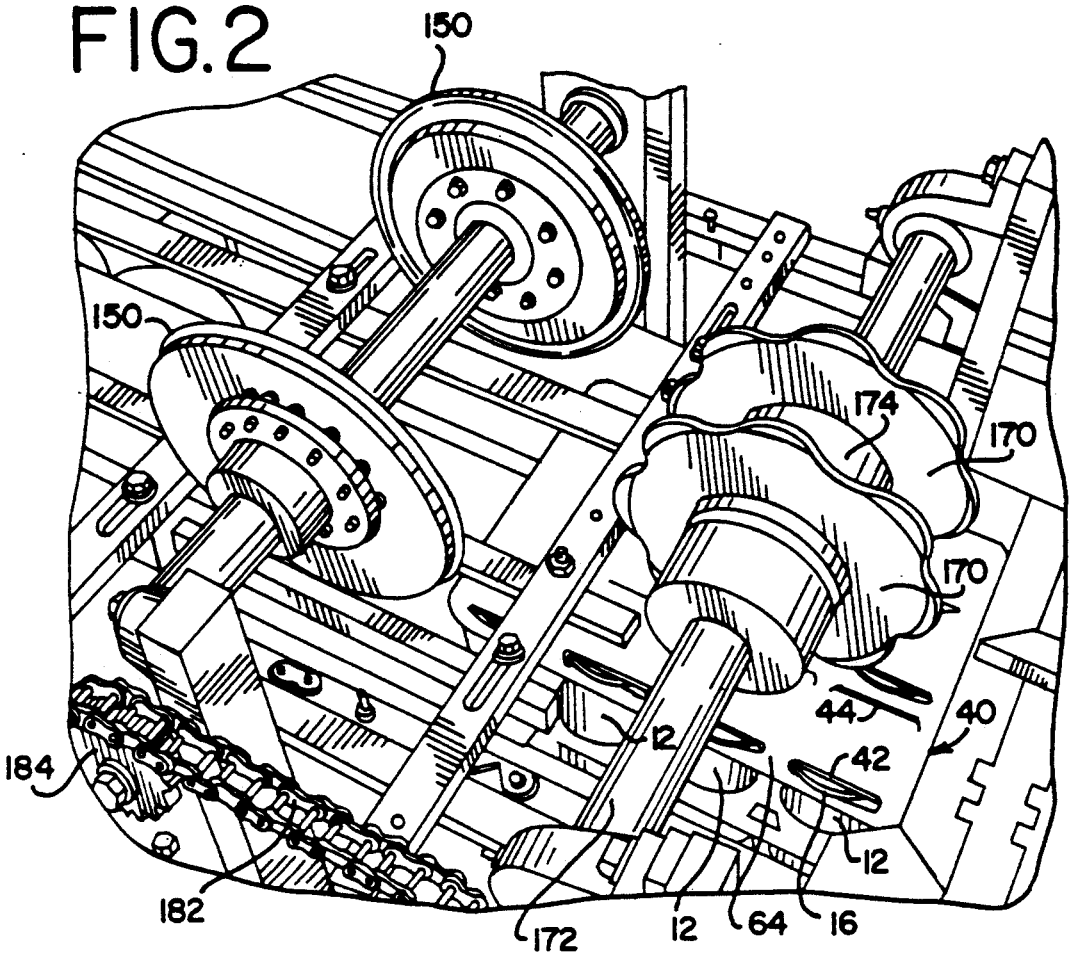
FIG. 2 is a fragmentary, perspective view of two pairs of wheels included in the machine, namely two lobar wheels and two circular wheels.

The lobar wheels 170 are mounted on a shaft 172 journalled in the machine 100, in transversely spaced relation to each other, so as to be conjointly rotatable with the shaft 172. Each lobar wheel 170 is mounted to the shaft 172 via hubs including a hub 174 spacing the lobar wheels 170. A sprocket 180 ks mounted on the shaft 172, at one end of the shaft 172, so as to be conjointly rotatable with the shaft 172 and with the lobar wheels 170. A timing chain 182 is engaged with the sprocket 180 and is connected to another sprocket 184 (see FIG. 2) which is driven directly or indirectly by the motor M driving the primary and the secondary conveyors so that rotation of the lobar wheels 170 is coordinated with operation of the primary and secondary conveyors.

Figure 3:
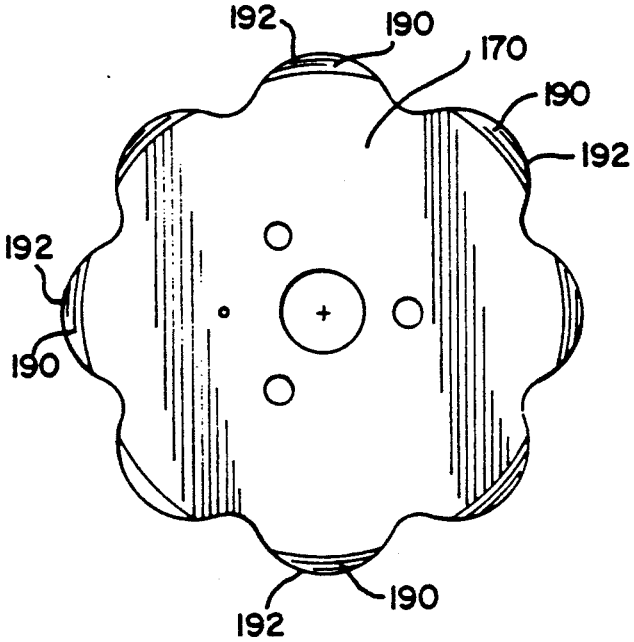
FIG. 3 is an elevational view of one face of a given one of the lobar wheels apart from the machine.
Figure 4:
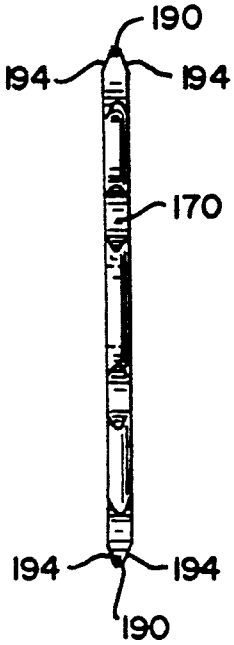
FIG. 4 is an elevational view of one edge of the same one of the lobar wheels apart from the machine.

Each lobar wheel 170 comprises eight uniform lobes 190 having curved edges 192 conforming generally to circular arcs (see FIG. 3) and being tapered on each side 194 (see FIG. 4). The lobar wheels 170 are rotatable in such manner that successive lobes 190 engage successive strips 50 of successive sheets 40 so as to clip successive stripe 50 beneath the chimes 16 of successive cane 12 as successive arrays are conveyed. The lobes 190 of each lobar wheel 170 engage the strips 50 in a respective one of the longitudinal lines on each sheet 40.

Rotation of the lobar wheels 170 is coordinated with operation of the primary and secondary conveyors, via the timing chain 182 and sprockets 182, 184, to ensure that successive lobes 190 engage successive strips 50 of successive sheets 40 to clip successive strips 50 beneath the chimes 16 of successive cans 12 as successive arrays are conveyed rather than contact areas of the sheets 40 not designed to be moved downwardly.

Because the lobes 190 have curved edges 192, the lobes 190 engage and press downwardly middle portions of the strips 50, as measured longitudinally. Because the lobes 190 are tapered on each side 194, the lobes 190 engage and press downwardly middle portions of the strips 50, as measured transversely. Because the lobes 190 engage middle portions of the strips 50, rather than edge portions thereof, the strips 50 do not tend to twist when engaged by the lobes 190. Rather, the lobes 190 deflect middle portions of the strips 50 downwardly beneath the chimes 16, without folding the strips 50.

It is important that the circular wheels 150 engage the edge portions 64, 74, of each sheet 40 before the lobar wheels 170 engage any of the strips 50 of such sheet 40. If the lobar wheels 170 were first to engage, stresses imparted by the lobar wheels 170 to such sheet 40 could force the outer cans 12 apart through lateral forces transmitted to the cans 12 by the edges of the strips 50, even beyond tolerances available because of the limited range of transverse motion of each circular wheel 150. The unrestrained lateral movement of the cans 12 could prevent the outer chime portions from being clipped or retained in the outermost slits 42, 44.

The machine 100 is useful for clipping a succession of the sheets 40 onto a succession of rectangular arrays of cans 12, so as to produce successive merchandising packages like the merchandising package shown in FIG. 6, at high speeds characteristic of modern filling and packaging operations.

Various modifications may be made in the preferred embodiment described above without departing from the scope and spirit of this invention.

I claim:

1. A machine for clipping a succession of generally planar sheets onto a succession of rectangular arrays of cans of a type having an end with a chime, wherein each sheet has multiple pairs of substantially parallel slits extending longitudinally in longitudinal rows and transverse ranks, at least one line of can-stabilizing strips disposed respectively between the pairs of slits and wherein the pairs of slits of successive sheets are similarly spaced in a longitudinal direction along each sheet and from each sheet to the successive sheet, the machine comprising (a) means for registering successive arrays of cans in such manner that successive cans are spaced regularly in a longitudinal direction and for conveying the registered arrays of cans in the longitudinal direction with the ends with the chimes facing upwardly and with one such sheet overlying the chimes of the cans of each array in such manner that the chime of each can is disposed in a centered position relative to the slits of one respective pair, and (b) means for clipping the overlying sheet onto the cans of each array as such array is conveyed in the longitudinal direction, the clipping means comprising a pair of circular, transversely spaced wheels arranged to engage successive edge portions of successive sheets and to fold the engaged portions in such manner that the folded portions are clipped beneath the chimes of outer cans in the rectangular arrays being conveyed.

2. The machine of claim 1 comprising means for mounting each circular wheel to permit such circular wheel to be transversely moveable over a limited range of motion and means for biasing each circular wheel toward an inner limit of said range.

3. The machine of claim 1 wherein the wheels are resilient relative to the cans so that the wheels may be transversely movable over a limited range of motion as they contact the cans.

* * * * *

UNITED STATES PATENT AND TRADEMARK OFFICE

CERTIFICATE OF CORRECTION

PATENT NO. : 5,323,585

DATED : June 28, 1994

INVENTOR(S) : Algimantas K. Kazlauskas

It is certified that error appears in the above-indentified patent and that said Letters Patent is hereby corrected as shown below:

Title page, item [57],
Abstract - line 13, "cane" should be --cans--.

Abstract - line 16, "cane" should be --cans--.

Col. 3, line 59, immediately before the second occurence of "slit", the "." should be deleted.

Col. 4, lines 25, 32, 38, "cane" should be --cans-- in all three instances.

Col. 4, line 50, "tope of cane," should be --tops of cans,--

Col. 5, lines 24, 30, and 36, "cane" should be --cans-- in all three instances.

Col. 6, line 19, "ks" should be --is--.

Col. 6, line 35, "cane" should be --cans--.

Signed and Sealed this

Twentieth Day of September, 1994

*Attest:*

Bruce Lehman

BRUCE LEHMAN

*Attesting Officer*

*Commissioner of Patents and Trademarks*